US006022838A

United States Patent [19]

Martynov et al.

[11] Patent Number: 6,022,838

[45] Date of Patent: Feb. 8, 2000

[54] INTERNAL COMBUSTION ENGINE CLEANING AND RECONDITIONING COMPOSITION

[76] Inventors: Oleg Mikhailovich Martynov, 1362 Susan Ave., Redlands, Calif. 92374; Igor Mikhailovich Martynov, Mikrorayon Primorski, 1-32, Irkutsk, Russian Federation, 664056

[21] Appl. No.: 09/248,916

[22] Filed: Feb. 11, 1999

[51] Int. Cl.[7] ..... C11D 7/16; C11D 7/10; C11D 7/24; C11D 7/44; C11D 7/60

[52] U.S. Cl. ..... 510/185; 510/186; 510/395; 510/397; 510/405; 510/407; 510/418; 510/508

[58] Field of Search ..... 510/185, 186, 510/395, 397, 405, 407, 418, 508

[56] References Cited

U.S. PATENT DOCUMENTS

| | | | |
|---|---|---|---|
| 1,386,385 | 8/1921 | Torossian | 510/185 |
| 1,497,836 | 7/1924 | Benedict | 510/186 |
| 3,981,781 | 9/1976 | Mori et al. | 510/386 |
| 4,724,819 | 2/1988 | Fleri | 123/668 |
| 4,807,578 | 2/1989 | Adams et al. | 123/198 A |
| 4,992,187 | 2/1991 | Adams et al. | 252/50 |
| 5,723,419 | 3/1998 | Czerwinski et al. | 508/589 |

*Primary Examiner*—Yogendra Gupta
*Assistant Examiner*—Christine E. Ingersoll

[57] ABSTRACT

A cleaning, polishing, and reconditioning composition of matter for internal parts of an engine, particularly suited for a cylinder of an internal combustion engine, composed of abrasive powder, chemical compositions of non-ferrous metals including nickel, sodium, cobalt, and molybdenum, and a carrier substance, which is either a dense liquid or has capacity of liquefying at temperatures existing within said engine.

9 Claims, No Drawings

INTERNAL COMBUSTION ENGINE CLEANING AND RECONDITIONING COMPOSITION

BACKGROUND—FIELD OF INVENTION

This invention relates to internal combustion engines, specifically to increasing the performance thereof by applying a composition, which cleans and reconditions internal parts of an engine cylinder.

BACKGROUND—DESCRIPTION OF PRIOR ART

A number of methods have been used to clean and reconditioning of the internal walls of the internal combustion engine cylinders. Methods of cleaning and reconditioning the walls usually involve disassembly of the cylinders and application of coating to the internal parts of cylinders. One of such methods is exemplified in U.S. Pat. No. 4,724,819. Methods, that do not require disassembly of the cylinders normally involve cleaning only. Such methods are exemplified by the U.S. Pat. No. 5,723,419 and U.S. Pat. No. 4992187. They usually involve application of cleaning composition by mixing it with oil or fuel. As an example, see U.S. Pat. No. 4,807,578.

These methods are inadequate for the following reasons.

First, disassembly of internal combustion engines normally requires professional help. It is costly and time consuming. Even when disassembled, internal parts of an engine require thermal treatment for the purpose of applying metal-coating.

Second, non-invasive cleaning methods do not provide for metal-coating and reconditioning of the internal walls of a cylinder and rings.

Third, cleaning solutions, mixed with oil or fuel, circulate throughout the entire oil/fuel systems. As a result, chemical compositions of cleaning solutions may be damaging to other parts of the engine and cannot be targeted at the engine part, which actually requires cleaning and reconditioning.

The object of this invention is to achieve the following advantages:

First, internal parts of cylinders are cleaned by abrasive powder. Unlike existing solutions, this method provides not only for removal of undesired build-ups but for polishing of the surfaces. As a result, the cleaning solution described herein achieves additional friction-reduction.

Second, concurrently with cleaning of the surfaces, the composition, subject of the instant invention, creates a non-ferrous metal coating on the internal parts of cylinders. In particular, as a result of friction, pressure, and temperature existing in such cylinders, non-ferrous metal additives are being alloyed upon the surfaces. As a result, the internal parts of cylinders are reconditioned; their life and efficiency increases.

Both parts of the composition are delivered by a carrying substance, which may be normal paraffin (for an example of obtaining normal paraffin, see U.S. Pat. No. 2,988,502); fuels; organic, mineral, or synthetic oils such as, for example, machine oil (5W30 or 10W30) or even olive oil; lubricants; or regular wax. Generally, the only essential requirement to a carrying substance is that it is a dense liquid or a material, which can liquefy at low temperatures.

OBJECTS AND ADVANTAGES

The objects of the instant invention are:

a) to create a composition that can be applied specifically to a cylinder of an internal combustion engine for the purpose of both cleaning and alloying its internal parts;

b) to create a composition, which can be applied to alloy and recondition internal parts of any engine, wherein increased friction, pressure, and temperature are present.

The advantages of this invention are:

a) the composition does not interface with parts of an engine, which are not sought to be cleaned;

b) the composition cleans internal parts of a cylinder, removes undesired build-ups, and polishes said internal parts so as to reduce friction.

c) the composition provides non-ferrous metal coating to internal parts of a cylinder, fills micro-cracks, and strengthens said parts;

d) composition, when used without abrasive, cleaning powder, may be added to general oil supply of an engine for the purpose of alloying various internal parts thereof, provided that the speed of such alloying is proportionate to friction, temperature, and pressure surrounding such various internal parts.

e) the tasks of cleaning and metal-coating, described herein, take place concurrently, without any need to disassemble cylinders and/or engine.

SUMMARY

The subject invention is a composition comprised of polishing powder, salts of non-ferrous metals, mixed with a dense liquid, wax, or paraffin compound.

DESCRIPTION OF INVENTION

The subject invention provides a composition of matter for cleaning internal parts of an internal combustion engine cylinder and applying non-ferrous metal coating, without any need for disassembly of the cylinders.

It is known that clean automotive engines operate more efficiently than those, which have accrued deposits of carbonized soil in the cylinder areas. Clean engines produce less pollutants.

The methods developed to deal with the pollution problem include the use of more highly refined gasoline mixtures, detergent gasoline, computerized fuel injection systems, and in the marketing of engine injector solutions designed to clean the offending deposits.

The instant invention not only achieves cleaning of cylinder areas of an internal combustion engine, it improves compression, and increases the quality of internal parts, thereby increasing efficiency of an engine and prolonging its life.

Chemical Composition

The invention is comprised of the mixture of the following components:

(a) powder of a solid natural non-ferrous material with impact hardness from 2 to 5.5 (Mos' scale), particle size ranging from 0.0008 to 250 mkm—from 0.1 to 95.0% by volume (marble, serpentine may be used);

(b) nickel sulfate, $NiSO_4$, from 0.01 to 40.0% by volume;

(c) cobalt sulfate, $CoSO_4$, from 0.01 to 40.0% by volume;

(d) sodium hypophosphide, $Na_3H_2PO_4$, from 0.01 to 35.0% by volume;

(e) molybdenum trioxide, $MoO_3$, from 0.01–20.0% by volume;

(f) normal paraffin, wax, oil, or dense liquid substance, the remaining volume.

Other compounds of non-ferrous materials may also be used in the mixture. For example, chemical compositions involving silver, copper, zinc, molybdenum, and chrome may also be applied to create durable and/or corrosion-resistant coating.

Application and Main Embodiment

Compound is applied directly into a cylinder of a previously warmed-up engine, through spark plug opening. After said application, engine must be turned on in order to start the process of cleaning and coating.

The embodiment tested on a number of automobiles was a composition consisting of:

ground marble (150–200 mesh)—51.3% by volume;

sodium acetate—1.1% by volume;

sodium hypophosphide—1.1% by volume;

molybdenum trioxide—3.5% by volume nickel sulfate—2.7% by volume;

cobalt sulfate—0.7% by volume melted normal paraffin—39.6% by volume.

However, within the aforementioned ranges, multiple combinations provide satisfactory functionality. As stated elsewhere herein, a multiple selection of carriers may be used to carry the composition to necessary parts of engine.

Operation

Once the composition is applied and the engine is turned on, said composition reaches the working parts of a cylinder. The solid-material powder cleans said working parts. It acts as a polishing agent and thereby cleans internal parts of a cylinder.

At the same time, pressure and temperature in the cylinder lead to chemical reactions which provide coating to the internal surfaces thereof. In particular, nickel sulfate and cobalt sulfate create durable and corrosion-resistant coating. Molybdenum trioxide increases anti-friction characteristics of said coating. Sodium hypophosphide acts as a reducer (deoxidizing agent).

In the environment of high friction, temperature, and pressure, nickel and cobalt alloying forms on the internal parts of cylinders. Diffusion of molybdenum additionally increases the strength of coating.

Conclusion, Ramifications, and Scope

Accordingly, the reader will see that the composition described herein achieves several tasks simultaneously: cleaning and strengthening. Clean engine produces less pollution. Coated parts of cylinders have longer lives, which is likely to have significant impact on the durability of the engine and the overall cost of its maintenance.

The fact that the above two tasks are performed simultaneously by application of the composition as well as the fact that the application is targeted to a particular area, which is sought to be cleaned and strengthened—are two major advantages of the instant invention.

Although the descriptions above contain many specific statements, claims, and descriptions, these should not be construed as limiting the scope of the invention but as merely providing illustrations of some of the presently preferred embodiments of this invention. The scope of the invention should be and is to be determined by the appended claims and their legal equivalents.

We claim:

1. A method of concurrently cleaning and reconditioning internal parts of an internal combustion engine cylinder comprising contacting said cylinder directly with a cleaning and reconditioning composition comprising a mixture of, (i) an abrasive powder selected from the group consisting of non-ferrous naturally found solid materials, said solid material having an impact hardness from 2 to 5.5 on the Mos Scale;

(ii) nickel sulfate, $NiSO_4$;

(iii) cobalt sulfate, $CoSO_4$;

(iv) sodium hypophosphate, $Na_3H_2PO_4$;

(v) molybdenum oxide, $MoO_3$, and;

(vi) a carrier substance which is a liquid or liquefies at temperatures within a cylinder of an internal combustion engine.

2. A method as in claim 1, wherein the carrier substance is automobile oil.

3. A method as in claim 1, wherein the carrier substance is olive oil.

4. A method as in claim 1, wherein the carrier substance is a machine lubricant.

5. A method as in claim 1, wherein the carrier substance is wax.

6. A method as in claim 1, wherein the carrier substance is organic fuel.

7. A method as in claim 1, wherein the carrier substance is a normal paraffin.

8. A method of concurrently cleaning and reconditioning internal parts of an internal combustion engine cylinder comprising contacting said cylinder directly with a cleaning and reconditioning composition consisting of a mixture of, (i) 0.1 to 95.0% by volume of an abrasive powder selected from the group consisting of non-ferrous naturally found solid materials, said solid material having an impact hardness from 2 to 5.5 on the Mos Scale, with a particle size ranging from 0.0008 to 250 mkm;

(ii) 0.01 to 40.0% by volume of nickel sulfate;

(iii) 0.01 to 40.0% by volume of cobalt sulfate;

(iv) 0.01 to 35.0% by volume of sodium hypophosphate;

(v) 0.01 to 20.0% by volume of molybdenum oxide, and;

(vi) the balance of a carrier substance which is a liquid or liquefies at temperatures within a cylinder of an internal combustion engine.

9. A method for alloying internal parts of an engine comprising contacting said internal parts with an alloying composition comprising a mixture of nickel sulfate, cobalt sulfate, sodium hypophosphide, molybdenum trioxide, and a carrier substance, which is a liquid or liquefies at temperatures within a cylinder of an internal combustion engine.

* * * * *